US008161874B2

(12) United States Patent
Belanger et al.

(10) Patent No.: US 8,161,874 B2
(45) Date of Patent: Apr. 24, 2012

(54) VARIABLE CUTOFF PRINTING UNIT WITH BELT BLANKET AND METHOD OF PRINTING

(75) Inventors: James Richard Belanger, Hampton, NH (US); Matthew Thomas Sharkady, Mulgrave (AU)

(73) Assignee: Goss International Americas, Inc., Durham, NH (US)

( * ) Notice: Subject to any disclaimer, the term of this patent is extended or adjusted under 35 U.S.C. 154(b) by 910 days.

(21) Appl. No.: 12/214,844

(22) Filed: Jun. 23, 2008

(65) Prior Publication Data

US 2009/0025583 A1 Jan. 29, 2009

Related U.S. Application Data

(60) Provisional application No. 60/937,621, filed on Jun. 28, 2007.

(51) Int. Cl.
*B41F 9/00* (2006.01)
*B41F 16/00* (2006.01)

(52) U.S. Cl. . 101/143; 101/217; 101/177; 101/DIG. 33; 101/DIG. 48

(58) Field of Classification Search ..... 101/DIG. 48, 101/DIG. 33, 368, 142, 143, 217, 218, 177
See application file for complete search history.

(56) References Cited

U.S. PATENT DOCUMENTS

| | | | | |
|---|---|---|---|---|
| 3,099,212 | A | | 7/1963 | Sohn |
| 3,691,948 | A | | 9/1972 | Southam et al. |
| 5,209,159 | A | | 5/1993 | Asanuma |
| 5,394,798 | A | | 3/1995 | Simon et al. |
| 5,454,316 | A | * | 10/1995 | Ohta et al. ..... 101/415.1 |
| 5,794,829 | A | | 8/1998 | Perrault |
| 5,813,336 | A | | 9/1998 | Guaraldi et al. |
| 5,816,151 | A | | 10/1998 | Wang et al. |
| 5,907,997 | A | | 6/1999 | Jackson et al. |
| 5,950,536 | A | | 9/1999 | Erbstein |
| 6,105,498 | A | | 8/2000 | Vrotacoe et al. |
| 6,205,920 | B1 | | 3/2001 | Dzierzynski et al. |
| 6,205,921 | B1 | | 3/2001 | Dzierzynski et al. |
| 6,327,975 | B1 | | 12/2001 | Izawa |
| 6,705,219 | B2 | | 3/2004 | Douillard et al. |
| 7,066,088 | B2 | | 6/2006 | McLean et al. |

(Continued)

FOREIGN PATENT DOCUMENTS

DE 81 22 637 7/1982

(Continued)

OTHER PUBLICATIONS

Web Offset, 2005, pp. 1 to 16, issue 56, Goss International Corporation, USA.

(Continued)

*Primary Examiner* — Judy Nguyen
*Assistant Examiner* — Leo T Hinze
(74) *Attorney, Agent, or Firm* — Davidson, Davidson & Kappel, LLC

(57) ABSTRACT

A variable cutoff printing press is provided. The variable cutoff printing press includes a first plate cylinder, a second plate cylinder, a continuous belt blanket contacting the first and second plate cylinders and a movable support cylinder supporting the belt blanket. The first and second plate cylinders, the continuous belt blanket and the movable support cylinder form a first print section and the movable support cylinder is movable to change the print length of the first print section. A method of printing images with a printing press is also provided.

7 Claims, 3 Drawing Sheets

U.S. PATENT DOCUMENTS

| | | | | |
|---|---|---|---|---|
| 2004/0020382 | A1 | 2/2004 | McLean et al. | |
| 2005/0061171 | A1 | 3/2005 | Angelo | |
| 2006/0162591 | A1* | 7/2006 | Schaede | 101/152 |
| 2006/0191428 | A1 | 8/2006 | McLean et al. | |
| 2006/0196373 | A1 | 9/2006 | McLean et al. | |

FOREIGN PATENT DOCUMENTS

| | | | |
|---|---|---|---|
| DE | 41 04 209 | A1 | 8/1992 |
| DE | 44 42 983 | A1 | 12/1994 |
| EP | 0 547 753 | A1 | 6/1993 |
| EP | 1 084 832 | A1 | 3/2001 |
| FR | 980 734 | | 5/1951 |
| JP | 7-266533 | | 10/1995 |
| WO | WO 95/20488 | | 8/1995 |
| WO | WO 00/16979 | A2 | 3/2000 |
| WO | WO 2004/014654 | A1 | 2/2004 |

OTHER PUBLICATIONS

Web Offset, Spring 2007, pp. 1 to 20, issue 60, Goss International Corporation, USA.

* cited by examiner

VARIABLE CUTOFF PRINTING UNIT WITH BELT BLANKET AND METHOD OF PRINTING

Priority is claimed to U.S. Provisional Application No. 60/937,621, filed Jun. 28, 2007, the entire disclosure of which is incorporated by reference herein.

BACKGROUND OF INVENTION

The present invention relates generally to a printing press and more specifically to a variable cutoff printing press and method.

U.S. Pat. No. 6,205,921 discloses a continuous image transfer belt which is useable in a variable image size offset press system and which is adapted to permit the press to print a variety of different sized printed matter is provided. The belt is used in an offset printing system having the capability to print variable-sized images. The system includes a source of ink; at least one plate cylinder and a replaceable sleeve for the plate cylinder, and a printing plate which is adapted to receive ink from the ink source. The system also includes at least one blanket cylinder; the image transfer belt positioned to contact the printing plate in a nip formed between the plate and blanket cylinders; an image transfer belt tensioning system to register the image transfer belt to the blanket cylinder position in the area of desired image transfer; and an image belt cleaning station adapted to remove residual ink from the surface of the belt.

U.S. Pat. No. 6,327,975 discloses a method and apparatus for printing elongate images on a web. A first printing unit prints a first image portion on the web at prescribed spacings, by moving the impression cylinder away from the blanket cylinder each time one first image portion is printed. A second printing unit prints a second image portion on the spacings left on the web by the first printing unit, also by moving the impression cylinder away from the blanket cylinder each time one second image portion is printed. A variable velocity motor rotates each blanket cylinder, while each time the associated impression cylinder is held away to create a space on the web for causing printing of the first or the second printing portion at required spacings.

U.S. Pat. No. 7,066,088 discloses a variable cut-off offset press system and method of operation which utilizes a continuous image transfer belt. The offset printing system comprises at least two plate cylinders adapted to have thereon respective printing sleeves. Each of the printing sleeves is adapted to receive colored ink from a respective ink source. The system further comprises at least an impression cylinder, wherein the image transfer belt is positioned to contact each of the printing sleeves at respective nips formed between respective ones of the plate cylinders and the at least one impression cylinder.

BRIEF SUMMARY OF THE INVENTION

A variable cutoff printing press is provided. The variable cutoff printing press includes a first plate cylinder, a second plate cylinder, a continuous belt blanket contacting the first and second plate cylinders and a movable support cylinder supporting the belt blanket. The first and second plate cylinders, the continuous belt blanket and the movable support cylinder form a first print section and the movable support cylinder is movable to change the print length of the first print section.

A method of printing images with a printing press is also provided. The method includes transferring a first image from a first plate cylinder to a belt blanket at a first location; transferring a second image from a second plate cylinder to the belt blanket at a second location directly adjacent to the first location; and printing the first and second images from the belt blanket to a web.

BRIEF DESCRIPTION OF THE DRAWINGS

The present invention is described below by reference to the following drawings, in which.

DETAILED DESCRIPTION

Figure 1:
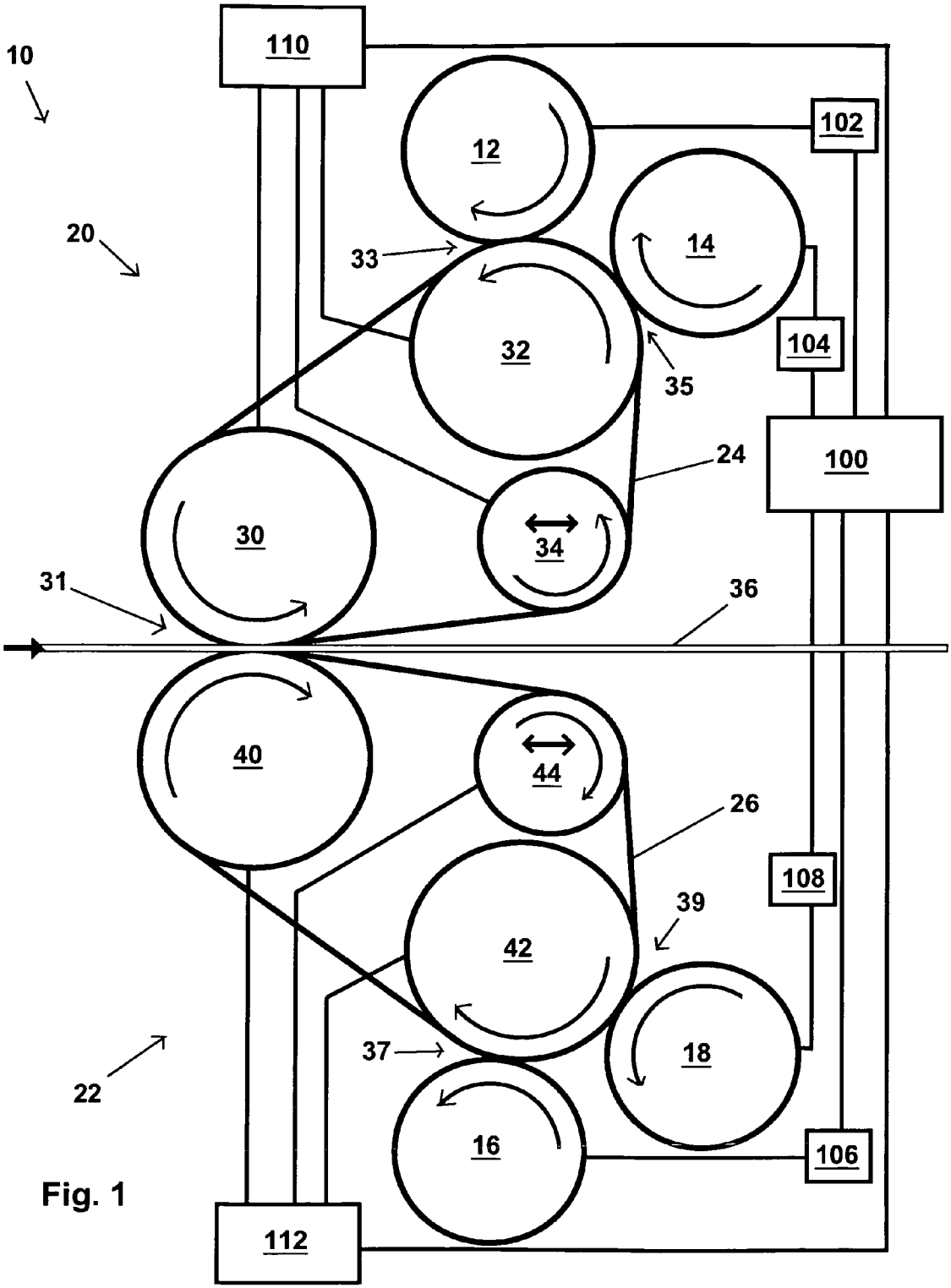
FIG. 1 shows an embodiment of a printing unit of the present invention having printing blankets in the form of belts.

FIG. 1 shows an embodiment of a printing unit 10 of the present invention having printing blankets 24, 26 in the form of belts. Printing unit 10 includes an upper printing section 20 and a lower printing section 22. Upper printing section 20 includes a first upper plate cylinder 12 and a second upper plate cylinder 14 and each plate cylinder 12, 14 transfers images to belt blanket 24. Belt blanket 24 is wrapped around support cylinders 30, 32, 34. Belt blanket 24 prints images received from plate cylinders 12, 14 on one side of a passing web 36. On the other side of web 36, lower printing section 22 includes a first lower plate cylinder 16 and a second lower plate cylinder 18 and each plate cylinder 12, 14 transfers images to belt blanket 26. Belt blanket 26 is wrapped around support cylinders 40, 42, 44. Belt blanket 26 prints images received from plate cylinders 16, 18 on one side of a passing web 36. In a preferred embodiment, plate cylinders 12, 14, 16, 18 each include a printing plate. In an alternative embodiment, images may be directly burned onto plate cylinders 12, 14, 16, 18.

Support cylinders 30, 32, 34 rotate clockwise to translate continuous belt 24 in a path that passes between nips 31, 33, 35. Nip 31 is formed between support cylinders 30, 40, nip 33 is formed between support cylinder 32 and plate cylinder 12 and nip 35 is formed between support cylinder 32 and plate cylinder 14. As belt blanket 24 passes through nip 35, plate cylinder 14 transfers a first inked image to belt blanket 24. After belt blanket 24 receives the first inked image and transport the first inked image past nip 33, plate cylinder 12 prints a second inked image directly following the first inked image on belt blanket 24.

Plate cylinders 12, 14 each have an outer surface portion that is prepared as a print area, which transfers images to belt blanket 24, and an outer surface portion that is prepared as a non print area, which does not transfer images to belt blanket 24. After plate cylinder 12 prints a first image on belt blanket 24, plate cylinder 14 continues to rotate and non print area of plate cylinder 14 passes by belt blanket 24, leaving a blank space on belt blanket 24 for plate cylinder 12 to print a second image. Plate cylinder 14 is phased such that after the proper length of blank space is left on blanked belt 24 for plate cylinder 12 to print a second image, print area of plate cylinder 14 contacts belt blanket 24, and plate cylinder 14 prints another first image on belt blanket 24. After plate cylinder 12 prints a second image on belt blanket 24, plate cylinder 12 continues to rotate and non print area of plate cylinder 12 passes by belt blanket 24 as a first image printed by plate cylinder 14 passes by plate cylinder 12. Plate cylinder 12 is phased such that after a first image printed by plate cylinder 14 passes by plate cylinder 12, print area of plate cylinder 14 contacts belt blanket 24, and plate cylinder 12 prints another second image on belt blanket 24 directly following a first image. Plate cylinders 12, 14 continuously operate in this manner, printing first and second images on belt blanket 24, ultimately leaving no blank space on belt blanket 24 between first and second images.

First and second images printed on belt blanket 24 are transferred from belt blanket 24 to passing web 36 at nip 31. Because first and second images on belt blanket 24 do not have intervening spaces, first and second images printed on web 36 do not have intervening spaces. Support cylinder 40 co-acts with support cylinder 30 during printing on web 36 by belt blanket 24, while belt blanket 26 prints images on the opposite side of web 36. Belt blanket 26 prints in the same manner as belt blanket 24, receiving images from plates cylinders 16, 18 at nips 37, 39, respectively, and printing the images on web 36 at a nip 31. In order to align the images printed by plate cylinder 12 with the images printed by plate cylinder 14, the circumferential phasing between plate cylinder 12 and plate cylinder 14 is a function of a length of blanket belt 24 between nips 33, 35. Similarly, the circumferential phasing between plate cylinder 16 and plate cylinder 18 is a function of a length of blanket belt 26 between nips 37, 39.

In a preferred embodiment, axes of cylinders 30, 32, 40, 42 are stationary and axes of cylinders 34, 44 are movable. In order to vary cutoff lengths of images printed by printing unit 10 on web 36, plates on plate cylinders 12, 14, 16, 18 may be exchanged with replacement plates carrying images of different lengths. When replacement plates are introduced, belt blankets 24, 26 may be accordingly replaced with replacement belt blankets of different lengths and the positions of support cylinders 34, 44, respectively, may be adjusted to accommodate the replacement belts. When only small changes in belt length are desired, belt blankets 24, 26 may be stretched by the adjustment of the positions of support cylinders 34, 44, respectively.

In the embodiment shown in FIG. 1, plate cylinders 12, 14, 16, 18 are the same size and plate cylinders 12, 14, 16, 18 are rotated by individual motors 102, 104, 106, 108, respectively. Support cylinders 30, 32, 34 are driven by a motor 110 and support cylinders 40, 42, 44 are driven by a motor 112. A controller 100 controls motors 102, 104, 106, 108, 120, 122. In another embodiment plate cylinders 12, 16 may be rotated by a single motor and plate cylinders 14, 18 may be rotated by a single motor. In other embodiments support cylinders 30, 32, 34, 40, 42, 44 may be driven by a single motor or one or more support cylinders 30, 32, 34, 40, 42, 44 may not be driven.

Plate cylinders 12, 14, 16, 18 may be rotated by motors 102, 104, 106, 108 at varying velocities during printing. When one half of the surface of each plate cylinder 12, 14, 16, 18 is prepared as print area, plate cylinders 12, 14, 16, 18 are rotated at a constant velocity during printing. When less than one half or more than one half of the surface of each plate cylinder 12, 14, 16, 18 is prepared as print area, plate cylinders 12, 14, 16, 18 are rotated at a varying velocities during printing operation.

Plate cylinders 12, 14, 16, 18 are rotated at varying velocities during each revolution to allow plate cylinders 12, 14, 16, 18 to travel at a velocity equal to respective belt blankets 24, 26 while each plate cylinder 12, 14, 16, 18 is printing an image on web 36, but also to be in a proper rotational position to print a next image on respective belt blanket 24, 26. Web 36 is traveling at a constant velocity and belt blankets 24, 26 are traveling at the same constant velocity as web 36. Thus, while plate cylinders 12, 14, 16, 18 transfer images to respective belt blankets 24, 26 plate cylinders 12, 14, 16, 18 must have constant surface velocities equal to those of belt blankets 24, 26. If greater than one half of the surface of a plate cylinder 12, 14, 16, 18 is prepared as the print area, the plate cylinder 12, 14, 16, 18 is decelerated after printing so that the plate cylinder 12, 14, 16, 18 is in proper position to print a next image. If less than one half of the surface of a plate cylinder 12, 14, 16, 18 is prepared as the print area, the plate cylinder 12, 14, 16, 18 is accelerated after printing so that the plate cylinder 12, 14, 16, 18 is in proper position to print a next image.

Figure 2:
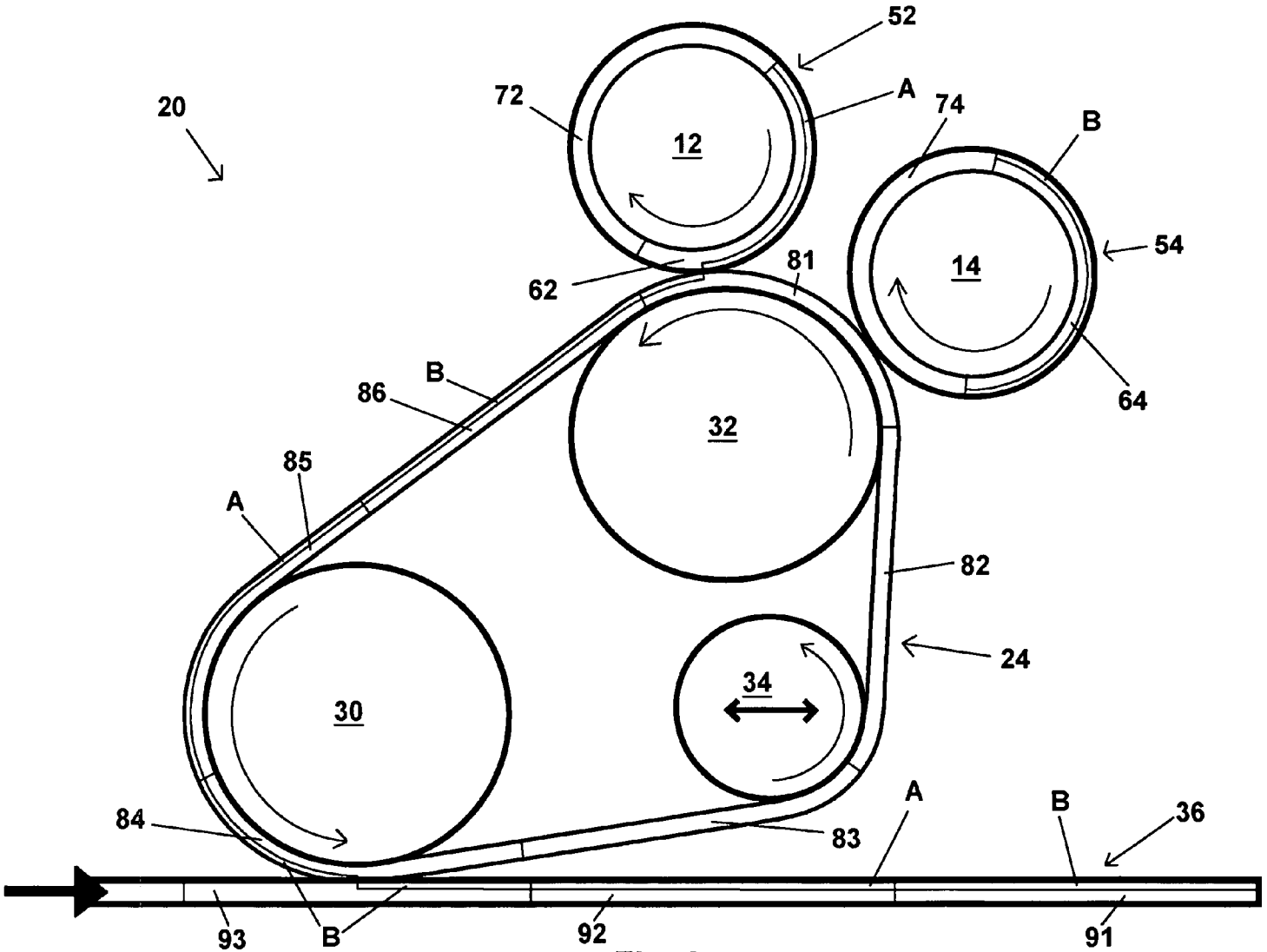
FIG. 2 shows an enlarged schematic side view of a upper printing section shown in FIG. 1 printing images on a web.

FIG. 2 shows an enlarged schematic side view of upper printing section 20 shown in FIG. 1 printing images A, B on web 36. Lower printing section 22 shown in FIG. 1 has been omitted for illustrative purposes only. Printing section 22 is configured similarly to printing section 20 and prints on the opposite side of web 10 in a manner similar to printing section 20. Plate cylinders 12, 14 include printing plates 52, 54, respectively, which print images A, B, respectively, on belt blanket 24. In one embodiment image A and image B may form one continuous image having a cutoff length. Plates 52, 54 are shown divided into print areas 62, 64, respectively, and non print areas 72, 74, respectively, for illustrative purposes. Print areas 62, 64 are longer than non print areas 72, 74. It should be noted that, in another embodiment, plates 52, 54 may not occupy the entire outer circumferences of plate cylinders 12, 14 and plates 52, 54 may not extend beyond print areas 62, 64 to non print areas 72, 74, as plates 62, 64 may be completely prepared as print areas 62, 64.

Outer surfaces of print areas 62, 64 are the same length. An outer surface of belt blanket 24 is six times the length of the outer surface of each print area 62, 64, or three times the cutoff length of the continuous image formed by image A and image B. Having a belt blanket 24 with an outer surface that is an integer multiple of the combined length of print areas 62, 64 can allow smudge-free printing without the use of belt cleaning devices, as plate cylinders 12, 14 print on the same portions of the outer surface of belt blanket 24 with each revolution of belt blanket 24. Belt blanket 24 is shown schematically divided into six printing spaces 81, 82, 83, 84, 85, 86. Plate cylinder 12 prints images A in spaces 81, 83, 85 and plate cylinder 14 prints images B in spaces 82, 84, 86.

Support cylinders 30, 32, 34 rotate belt blanket 24 such that a surface velocity of belt blanket 24 matches a velocity of web 36. Plate cylinder 12 is being rotated so that a surface velocity of plate 52 is equal to the surface velocity of belt blanket 24 as plate cylinder 12 prints image A in space 81 on belt blanket 24. After plate cylinder 12 completes printing image A, plate cylinder 12 is accelerated, causing plate cylinder 12 to travel at a surface velocity that varies from a velocity of web 36 as non print area 72 passes by belt blanket 24. Before print area 62 comes back into contact with belt blanket 24 to print image A in space 83, plate cylinder 12 is decelerated so that the outer surface of plate cylinder 12 is traveling at velocity equal to the outer surface velocity of belt blanket 24.

Plate cylinder 14 is being rotated so that when print area 64 contacts belt blanket 24, print area 64 is aligned to print image B in space 82 and plate cylinder 14 has a surface velocity that equals the surface velocity of belt blanket 24. Plate cylinder 14 may be in the process of being decelerated, and thus is traveling at a velocity that varies from the velocity of web 36, because plate cylinder 14 was accelerated after printing image B in space 86 on belt blanket 24.

The rotation of plate cylinders 14, 17 at surface velocities that vary from the velocity of belt blanket 24 may be achieved via relief as shown in FIG. 2. Also, for example, surfaces of plate cylinders 14, 17 may possibly slip in relation to blanket belt 24 via a special non stick coating on the non print areas 72, 74 of plate cylinders 12, 14 that does not affect the travel of belt blanket 24. In one embodiment, such a non stick coating may be used only on plate cylinder 14 if the coating does not prevent smearing by plate cylinder 12 of images B printed by plate cylinder 14 on belt blanket 24. In another embodiment, to prevent smearing by plate cylinder 12 of images B printed by plate cylinder 14, a heat setter my dry web 36 as web 36 passes between plate cylinders 12, 14. During slipping, axes of cylinders 12, 14 may remain stationary.

Belt blanket 24 is printing image B that was printed in space 84 by plate cylinder 14 in a space 93 on web 36. Belt blanket 24 previously printed image A in a space 92 on web 36, following printing image B in a space 91 on web 36.

Figure 3:
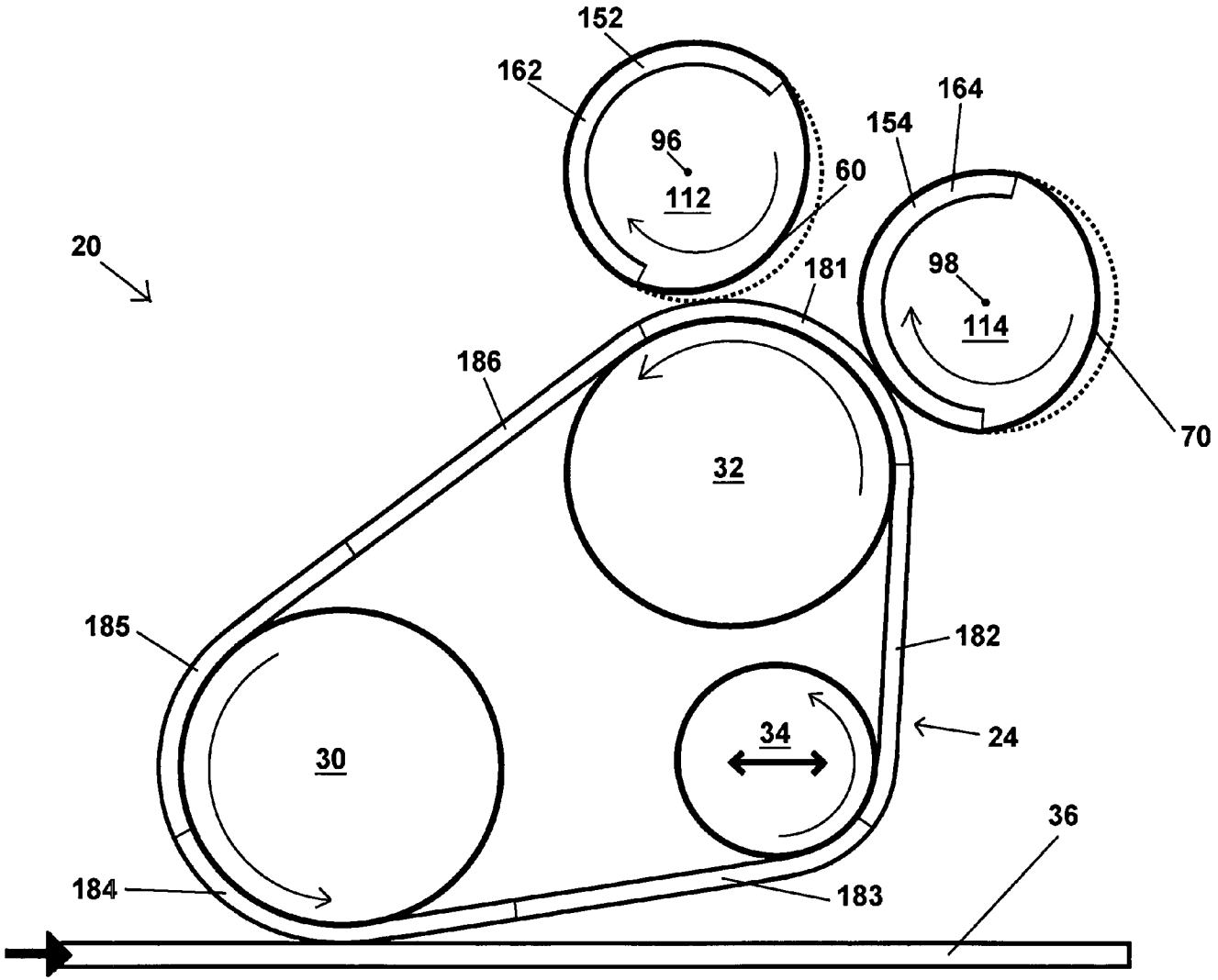
FIG. 3 shows a schematic side view of an embodiment of upper printing section shown in FIG. 2 equipped with plate cylinders including relieved portions.

FIG. 3 shows a schematic side view of an embodiment of upper printing section 20 shown in FIG. 2 equipped with plate cylinders 112, 114 including relieved portions 60, 70, respectively. Relieved portions 60, 70 do not contact belt blanket 24 during rotation of plate cylinders 112, 114 and allow plate cylinders 112, 114 to be accelerated and decelerated about center axes 96, 98, respectively, when cylinders 112, 114 are not printing images on belt blanket 24. Plate cylinder 112 prints images in spaces 181, 183, 185 on belt blanket 24 by contacting belt blanket 24 with a plate 152 that occupies the portion of the surface of plate cylinder 112 that is not relieved. Plate cylinder 114 prints images in spaces 182, 184, 186 on belt blanket 24 by contacting belt blanket 24 with a plate 154 that occupies the portion of the surface of plate cylinder 114 that is not relieved. Belt blanket 24 prints images printed in spaces 181, 182, 183, 184, 185, 186 by plate cylinders 112, 114 on web 36. The entire outer surfaces of plates 152, 154 are prepared as print areas 162, 164, respectively.

A cutoff length of images printed by printing section 20 may be changed, for example, by replacing plates 152, 154 with replacement plates equal in length to plates 152, 154, but that include a shorter print area. Plates 152, 154 may also be replaced by replacement plates having outer surfaces prepared entirely as print areas, but that are shorter than plates 152, 154. Belt blanket 24 may be removed from support cylinders 30, 32, 34 and replaced with a belt blanket of a shorter length, which is an integer multiple of the combined length of the new print areas, to accommodate images having shorter cutoffs. A position of support cylinder 34 may be adjusted to fit the replacement belt blanket.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of printing images with a printing press comprising:

transferring a first image from a first plate cylinder to a belt blanket at a first location;

moving the belt blanket so the first location of the belt blanket passes by a second plate cylinder without the second plate cylinder printing on the first image;

transferring a second image from the second plate cylinder to the belt blanket at a second location directly adjacent to the first location; and printing the first and second images from the belt blanket to a web.

2. The method of printing images with a printing press recited in claim 1 further comprising:

varying the length of the first and second images transferred to the belt blanket;

varying the length of the belt blanket according to the varied length of the first and second images by moving a movable support cylinder;

printing the first and second images of the varied length on the web.

3. The method of printing images with a printing press recited in claim 2 wherein varying the length of the belt blanket includes removing the belt blanket and replacing the belt blanket with a replacement belt blanket of a length that is different from a length of the belt blanket and moving the movable support cylinder to accommodate the length of the replacement belt blanket.

4. The method of printing images with a printing press recited in claim 2 wherein varying the length of the belt blanket includes stretching the belt blanket by moving the movable support cylinder.

5. The method of printing images with a printing press recited in claim 2 wherein varying the length of the first and second images transferred to the belt blanket includes removing a first plate from the first plate cylinder and replacing the first plate with a first replacement plate of a first replacement length that is different from a first length of the first plate and removing the second plate from the second plate cylinder and replacing the second plate with a second replacement plate of a second replacement length that is different from a second length of the second plate.

6. The method recited in claim 1 further comprising:

transferring the first image from the first plate cylinder to the belt blanket at a third location directly adjacent to the first location;

moving the belt blanket so the third location of the belt blanket passes by the second plate cylinder without the second plate cylinder printing on the first image; and transferring the second image from the second plate cylinder to the belt blanket at a fourth location directly adjacent to the third location.

7. The method of printing images with a printing press recited in claim 6 further comprising varying the velocity of the first plate cylinder after the first image is transferred to the belt blanket at the first location and before the first image is transferred to the belt blanket at the third location and varying the velocity of the second plate cylinder after the second image is transferred to the belt blanket at the second location and before the second image is transferred to the belt blanket at the fourth location.

* * * * *